US005945902A

United States Patent [19]

Lipkes et al.

[11] Patent Number: 5,945,902

[45] Date of Patent: Aug. 31, 1999

[54] CORE AND COIL STRUCTURE AND METHOD OF MAKING THE SAME

[75] Inventors: Zeev Lipkes, Poway; Joseph W. Crownover, La Jolla, both of Calif.

[73] Assignee: Zefv Lipkes, Poway, Calif.

[21] Appl. No.: 08/935,124

[22] Filed: Sep. 22, 1997

[51] Int. Cl.[6] ..... H01F 5/00; H01F 27/28; H01F 7/06

[52] U.S. Cl. ..... 336/200; 336/223; 336/232; 336/172; 29/602.1

[58] Field of Search ..... 336/200, 221, 336/223, 231, 172; 29/602.1

[56] References Cited

U.S. PATENT DOCUMENTS

| | | | |
|---|---|---|---|
| 3,765,082 | 10/1973 | Zyetz | 336/200 |
| 3,812,442 | 5/1974 | Muckelroy | 336/83 |
| 3,833,872 | 9/1974 | Marcus et al. | 336/83 |
| 4,543,553 | 9/1985 | Mandai et al. | 336/83 |
| 4,689,594 | 8/1987 | Kawabata et al. | 336/200 |
| 4,803,453 | 2/1989 | Tomono et al. | 336/183 |
| 5,017,902 | 5/1991 | Yerman et al. | 336/83 |
| 5,032,815 | 7/1991 | Kobayashi et al. | 336/83 |
| 5,045,380 | 9/1991 | Kobayashi et al. | 428/195 |
| 5,250,915 | 10/1993 | Ikeda et al. | 333/181 |
| 5,251,108 | 10/1993 | Doshita | 361/792 |
| 5,278,526 | 1/1994 | Ikeda | 333/185 |
| 5,302,932 | 4/1994 | Person et al. | 336/200 |
| 5,392,019 | 2/1995 | Ohkubo | 336/200 |
| 5,499,005 | 3/1996 | Gu et al. | 333/246 |
| 5,552,756 | 9/1996 | Ushiro | 336/200 |
| 5,598,135 | 1/1997 | Maeda et al. | 336/200 |
| 5,788,854 | 8/1998 | Desaigoudar et al. | 336/200 |

FOREIGN PATENT DOCUMENTS

| | | | |
|---|---|---|---|
| 58-67007 | 4/1983 | Japan | 336/200 |
| 5-243057 | 9/1993 | Japan | 336/200 |

OTHER PUBLICATIONS

Hiroe Yamada, *Patent Abstracts of Japan* 10(279) (1986).
Pioneer, *Patent Abstracts of Japan* 7(170) (1983).
TDK Corp, *Patent Abstracts of Japan* 7(84) (1983).
TDK Corp, *Patent Abstracts of Japan* 17(579) (1993).

*Primary Examiner*—Lincoln Donovan
*Assistant Examiner*—Anh Mai
*Attorney, Agent, or Firm*—Lyon & Lyon LLP

[57] ABSTRACT

An inductive device is comprised of a plurality of dielectric wafers having conductive patterns disposed thereon and being formed into a laminate structure. The laminate structure includes a ferromagnetic core encased within the dielectric material. The conductive patterns are interconnected using vias to create a conductive structure, such as windings, about the core. During fabrication of the device, the core is pressurized to maintain high-permeability characteristics. As a result, inductive devices such as transformers and inductors can be made having small dimensions and high inductive values.

21 Claims, 11 Drawing Sheets

CORE AND COIL STRUCTURE AND METHOD OF MAKING THE SAME

BACKGROUND OF THE INVENTION

1. Field of the Invention

This invention relates generally to inductive devices, and in particular to a laminated multi-layered inductive device and method of making the same.

2. Description of the Related Art

Early microcircuit and designers avoided inductive surface mount components such as transformers and inductors because of the relatively large physical size of such devices. Eventually, micro size inductive components were developed, however, these components exhibited extremely low values of inductance (e.g. from nano Henrys up to one micro henry). As a result, they could only be used at high frequencies, such as for microwave frequency circuits.

One conventional solution, as illustrated in U.S. Pat. No. 3,765,082 to Zytez, attempted to overcome these problems by using a monolithic inductor chip. However, the coil design in such conventional solutions is inefficient and is incapable of obtaining as high inductance levels as the present invention, because it only uses ferrite wafers to form the laminate structure. As a result, high permeable ferrite was generally not used, as it tended to short out the conducting lines (e.g. windings) of the device.

SUMMARY

Accordingly, there has been a long felt need in the art for a small sized inductor, transformer or other inductive device having high-permeability core, which may be used in a broad range of frequency applications.

In certain embodiments of the invention, the invention facilitates the construction of devices having relatively large permeability values and small physical size, and which are capable of operating at high power levels within low to microwave frequency ranges. In certain embodiments, the devices according to the invention are provided with dimensions of approximately one-half to one inch per side and 50–60 mils in thickness while maintaining a high level of inductance, such as, for example 20 mH.

In another embodiment, the device can be provided with dimensions of approximately 100 by 120 mils with a similar thickness, while maintaining a high level of inductance, such as, for example, 100 $\mu$H. In yet another embodiment, the device can be provided with dimensions of approximately 40 by 20 mils with a similar thickness, while maintaining a high level of inductance, such as, for example, 1 to 10 $\mu$H.

One aspect of the present invention is the unique winding shape and dimension of the inductor coil so as to maximize the magnetic properties of the ferromagnetic materials being used.

Another aspect of the present invention is the use of non-conducting, non-magnetic wafers such as alumina ceramic wafers which have first holes formed in their center and second holes formed in their periphery. Conductive ink, such as silver, copper, gold or some other suitable conductor, is then printed onto the wafers in a predetermined pattern. This may be done by a screen printing process. The second holes (vias) are also filled with the conductive ink. The first opening is filled with a ferromagnetic material, such as, for example, powdered ferrite. The ferromagnetic material can also be prepared in the form of a printable ink and printed into the first opening.

The predetermined patterns of the conductive ink and the position of the vias are selected such that when the ceramic wafers are placed together in a layered fashion such that the patterns and vias cooperate to form conductive windings about the first openings. As the first openings have been filled with the ferrite material, this results in a winding structure surrounding a ferromagnetic core. Once this laminate structure has been completed, top and bottom ceramic wafers are attached to the laminate structure. Vias can be used to provide leads to the external portion of the laminate structure, such as, for example, to provide surface mount contacts. The entire structure is fired, at a temperature sufficient to sinter the ceramic. With the proper choice of ceramic materials, the sintering process shrinks the ceramic and pressurizes the ferromagnetic core.

To form a toroidal structure, two core areas are provided in the wafers. In this embodiment, top and bottom wafers include an area covered in ferromagnetic material so as to electrically connect the two ferromagnetic cores at the top and bottom of laminate structure.

Because in certain embodiments non-magnetic wafers (such as, for example, alumina) are used, highly permeable ferromagnetic material may be used to form the core, without the concern that the conductive lines will be shorted out by the ferromagnetic material. For example, the ferromagnetic material to be used may have 50 ohms-centimeter resistivity while having up to, for example, 10,000$\mu$ permeability. Materials suitable for such applications can include, for example, iron oxide with a maganese-zinc additive.

Furthermore, in one embodiment, the structure is preheated to burn off any organic material it contains and to naturally shrink the device thereby compressing the ferromagnetic core and achieving better permeability characteristics.

In other embodiments, highly resistive ferromagnetic material is used to form the wafers and no separate core is needed. For example, a Zinc-Nickel composition can be used to form the wafers. In these embodiments, because there is no separate core structure and hence no dielectric forming an insulating barrier between the ferromagnetic material and the conductive windings, a lower permeability and higher resistivity ferromagnetic material is used. For example, in one embodiment, the wafers have up to 3000$\mu$ permeability and $10^{-6}$ ohms centimeter resistivity.

Another aspect of the present invention is directed to a unique winding design which achieves enhanced inductance values. In particular, a unique torodial inductor or a transformer can be formed according to this aspect of the invention.

In this embodiment, a plurality of wafers are formed as follows: For a particular wafer having a length and width, two ferrite receiving holes are formed which extend in parallel to one another and are disposed lengthwise along the wafer. Adjacent to the first of these ferrite receiving holes, a first conductive ink pattern is formed thereon which extends substantially straight and parallel to the ferrite receiving hole. Between the first and second ferrite holes, a second conductive ink pattern is formed. The second conductive ink pattern is generally U shaped, wherein its base is approximately parallel to the first conductive ink pattern, and its legs extend away from the first conductive ink pattern. The conductive ink patterns are formed such that when two wafers are joined together, such that the patterns are 180° apart from one another, they form two separate windings about each core.

A plurality of such wafers are joined together. In an end wafer used in forming an inductor, the winding about the first core is shorted out to the winding of the second core.

Also, bottom and top plates and bridge plates are attached to the stack. The bridge plates include ferromagnetic material disposed thereon such that the first and second cores are joined together to form a toroid and a single inductor is formed which is electrically equivalent to a single conductor being folded in a U shape with a single winding turning about the entire U. For a transformer, windings on wafers in the center of the stack are shorted and joining wafers are used to allow the core to continue between the sets of windings. Regardless of the device being made, the entire group of wafers is laminated and sintered.

For example, in one embodiment, the group of wafers is laminated at a pressure of approximately 3000 PSI at a temperature of 80–100 degrees Centigrade to form the laminate structure. Next, the laminated structure is sintered at high temperature. This step pressurizes the core to enhance its permeability. In one embodiment, the sintering step is performed at as high a temperature which can be used without melting the conductive windings. For example, for a silver or silver alloy conductor, the package is fired at approximately 920 degrees Centigrade. This step causes the dielectric material to shrink and further compresses the core, enhancing its permeability.

In one embodiment, the sintering step is performed without added pressure (e.g., at one atmosphere).

An additional pre-firing step can be used to burn off organic material in the wafers.

In addition, as a result of the firing, the ferromagnetic core and any bridge plates, joining plates, and top and bottom plates used will be formed into a single structure. Consequently, only negligible permeability losses are experienced at the junction between the top and bottom plates and the core. This is a great enhancement over the conventional devices wherein the top and bottom plates are attached to the core via glue or other mechanical means.

In yet another embodiment, post-firing densification can be used after the sintering step to provide additional densification of the device structure. In this embodiment, the device is heated at high temperatures and pressurized (e.g., 920-degrees Centigrade for silver conductors at 3000 PSI). This additional step enhances qualities of the materials in a single step by using isostatic pressure at high temperature.

Because the wafers used in the described devices are formed into a stack, careful placement of the components printed thereon is crucial to provide proper alignment throughout the stack.

The terms "top" and "bottom" used in this document refer to relative locations of the ends of the laminate structure and do not mandate a particular spatial orientation of the device with respect to a fixed or variable frame of reference.

BRIEF DESCRIPTION OF THE DRAWINGS

The present invention is now described with reference to the accompanying drawings. It should be noted that the drawings are not necessarily drawn to scale.

DETAILED DESCRIPTION

The present invention is described with respect to various embodiments; however, it should be recognized that these are only provided as specific examples, and many other embodiments and designs are within the purview of one of ordinary skill in the art and within the scope of the invention.

According to one embodiment of the invention, an inductor, transformer or other inductive device is formed with dielectric (for example, ceramic or other non-conductive material) wafers having a ferrite or other ferromagnetic core. This embodiment provides advantages over conventional ferrite-loaded ceramic devices in that it allows highly permeable ferrite to be used without shorting with the conductive windings.

Figure 1A:
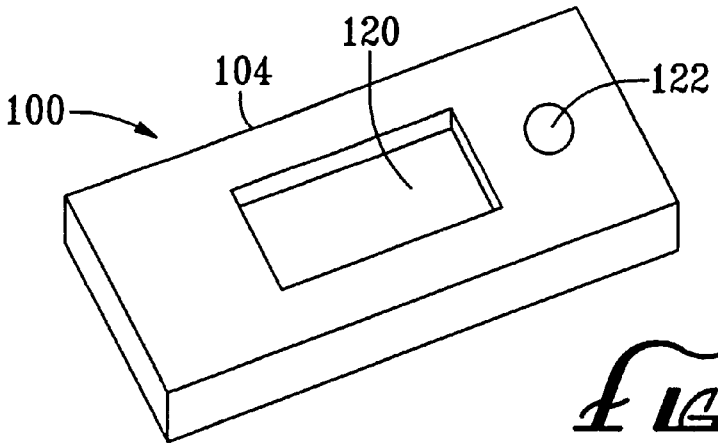
FIGs. 1A, 1B and 1C are diagrams illustrating three phases of a wafer in fabrication according to one embodiment of the invention.
Figure 1B:
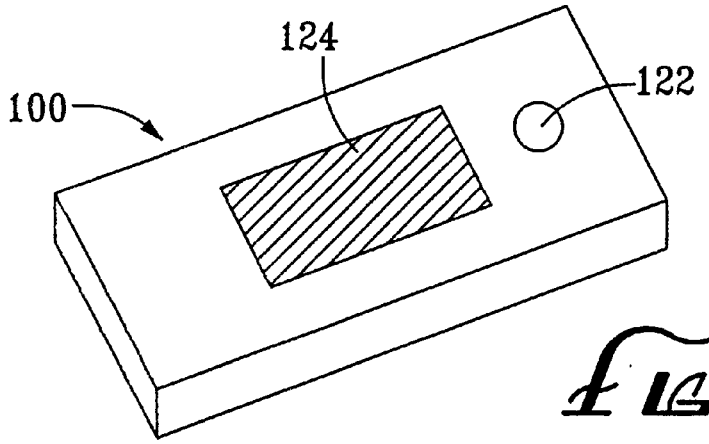
Figure 1C:
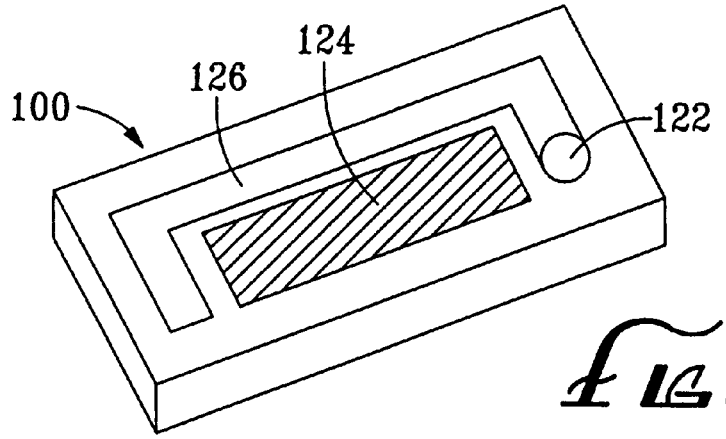
Figure 2:
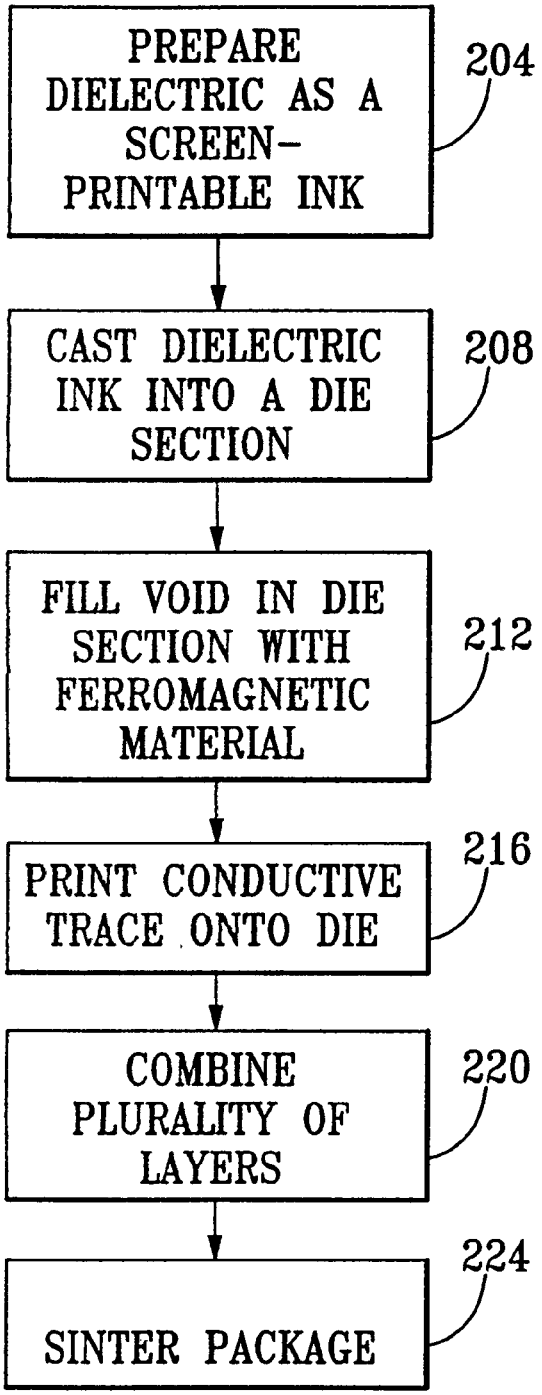
FIG. 2 is a diagram illustrating a process for fabricating wafers, such as wafers illustrated in FIG. 1, and for assembling the wafers into a device according to one embodiment of the invention.

A process of making a device according to one embodiment of the invention is now described. FIGS. 1A, 1B and 1C are diagrams illustrating three phases of a wafer 100 in fabrication according to one embodiment of the invention. FIG. 2 is a diagram illustrating a process for fabricating wafers, such as wafers 100 illustrated in FIG. 1, and for assembling wafers 100 into a device.

Referring now to FIGS. 1A, 1B, 1C and 2, in a step 204, a substrate medium, such as for example a dielectric material, is prepared as a screen printable ink. In one embodiment, alumina is used as the dielectric material. In alternative embodiments, other dielectric materials are used. In this document, the material is referred to as a "non-conductive" material. As would be apparent to one of ordinary skill in the art after reading this description, the resistivity and dielectric characteristics of the material can be chosen based on the desired device characteristics.

In a step 208, the dielectric ink is cast into a die section 104. The pattern illustrated in FIG. 1A includes a dielectric die section 104 having a center void or cavity 120 and a via 122. In the present embodiment where the dielectric material is prepared as a printable ink, a die section 104 can be cast by printing the dielectric ink in a preferred pattern. In one embodiment, the printing process for printing die section 104 is a screen printing process, although other printing or casting processes can be used.

The dielectric ink can be printed on a mylar film from which it can later be separated. In one embodiment, the thickness of dielectric material is approximately 1–10 mils, although other thicknesses can be used. In one embodiment, cavity 120 is provided in the dielectric section using a punch, such as, for example, a pneumatically-controlled punch.

In a step 212, cavity 120 is filled with a ferromagnetic material 124 such as, for example, ferrite. In one embodiment, this is also accomplished using a screen printing process to print ferromagnetic material 124, which is prepared as a printable ink, into cavity 120. The ferromagnetic material used in one embodiment is a powdered ferrite material having a permeability of up to 10,000$\mu$.

In a step 216, a conductive pattern 126 is disposed onto wafer 100 and vias 122. In one embodiment, this can also be accomplished using a screen printing or other printing process. Conventional etching and/or embossing techniques can be used as well to increase the cross section of the conductor ink embedded in the ceramic. Conductive pattern 126 can be made of copper, silver, gold, palladium silver or other conductive material.

The actual layout of conductive patterns 126, cavities 120 and vias 122 are chosen based on the type of device desired and its characteristics. Example alternative embodiments for different layout arrangements are discussed in detail below, although additional alternatives are within the scope of the invention.

In one embodiment, conductive pattern 126 is disposed on the surface of wafer 100. It is preferable to facilitate close stacking of wafers 100. However, for performance reasons it is also desirable to increase the thickness of the conductor to increase conductivity. To enable an increase in thickness, in an alternative embodiment a trench is created in wafer 100 and the conductive pattern 126 is disposed in this trench. As such, a thicker conductive pattern 126 can be used than embodiments where the conductor is disposed on the surface of wafers 100.

In a step 220, a plurality of wafers 100 are combined to create the desired device. In this step, wafers 100 are stacked on top of one another such that ferromagnetic material within wafers 100 is aligned, thus forming a ferromagnetic core. In one embodiment, 16 wafers 100 are used, although other quantities can be used as well. Preferably, the wafers are dried at moderate temperatures before stacking. In one embodiment, for example, the wafers are dried at 50-degrees Centigrade for approximately five to ten minutes.

In one embodiment, the wafers are pressurized during lamination to form the device structure. For example, the wafers can be pressurized at 3000 PSI and heated at 80–100 degrees Centigrade during lamination.

Figure 7:
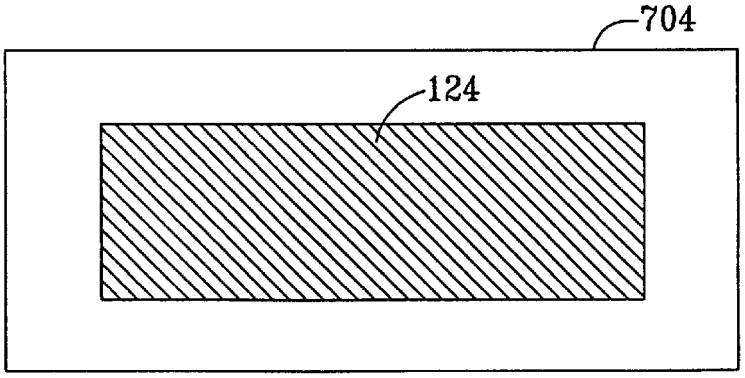
FIG. 7 is a diagram illustrating a bridge plate including an area of ferromagnetic material used to form a bridge according to one embodiment of the invention.

Preferably, stacked wafers 100 include cover plates, or caps, for the top and bottom of the stack and the stack is laminated. As a result, the ferromagnetic core is completely encased within a dielectric cavity. Additionally, in embodiments having multiple cores, bridge plates (illustrated in FIG. 7) can be used to form a ferromagnetic bridge between the cores.

In combining wafers 100, vias 122 are used to electrically connect conductors 126 among wafers 100 to achieve a desired coil or other conductive structure. Additional conductors (not illustrated in FIGS. 1A–1C) can be disposed on wafers 100 to interconnect vias and to enable external connections to conductors 126. The manner in which conductors 126 are disposed onto wafers 100 and interconnected is discussed in more detail below according to several embodiments.

In a step 224, the laminated package is heated at a moderate temperature and preferably for several hours to remove organic material. The package is next fired at high temperature. The high-temperature firing causes shrinkage of the dielectric material, thus compressing the core which enhances its permeability characteristics.

For example, in one embodiment, the package is heated at approximately 350 degrees Centigrade for approximately 20 hours to remove organic material. The package is next fired at approximately 920 degrees Centigrade for approximately one hour to sinter the package. In one embodiment, the package is not pressurized during these firing and heating steps; these steps are performed at ambient pressure. Additionally, the package can be further pressurized after firing to enhance structure densification using, for example, isostatic pressure.

To enable the use of high-permeability ferromagnetic material 124, the invention takes advantage of a shrinkage factor of the dielectric material which surrounds the core. As stated above, the dielectric material shrinks during the sintering process, compressing the ferromagnetic core.

Conventional materials and processes which do not compress the ferromagnetic core can suffer from a sublimation of resinous content of the ferromagnetic material and air gap between the ferromagnetic particles. Such conditions can lead to decreased device permeability. In these conventional systems, during the sintering process, resinous content of the core is sublimed out of the core, leaving loose particles of ferromagnetic material (e.g., ferrite) with a low permeability level. The compression provided according to the present invention minimizes the sublimation such that the core maintains a high-degree of permeability.

For example, alumina as a dielectric material has a shrinkage factor of approximately 10–20 percent. With this material, the core could be compacted by as much as 50 percent, depending on the dimensions of the structure, the sintering temperatures and other factors.

In addition to the shrinkage factor of the dielectric material, the compactability of the core is an important parameter. It is desirable to achieve sufficient compacting of the core to achieve high permeability, without shattering the dielectric casing. A properly designed package matches the tensile strength of the dielectric material to the compressive force of the core to achieve a properly compacted core.

In one embodiment, ferrite powder is used to form a ferrite ink. The resin-to-ferrete powder ratio of the ferrite used in the process determines the compactability of the core and is thus of considerable importance.

Also note that there are tradeoff considerations which must be made when considering materials to use and temperature ranges for the process. Processing the device at higher temperatures yields a better structure with a better core. However, higher temperatures can be destructive to good conductors. Therefore, where higher device temperatures are used, generally, a poorer conductor must be used. For example, silver is an excellent conductor but can't be sintered at high temperatures, whereas palladium is a worse conductor which can be sintered at very high temperatures.

Because the compression of the core allows for high permeability levels, devices according to the invention can be made smaller than otherwise possible with conventional techniques. For example, devices can be made with thicknesses on the order of 50 mils, which is suitable for most current surface mount applications. One such application of surface mount devices is PCMCIA cards used with laptop computers.

Figure 3:
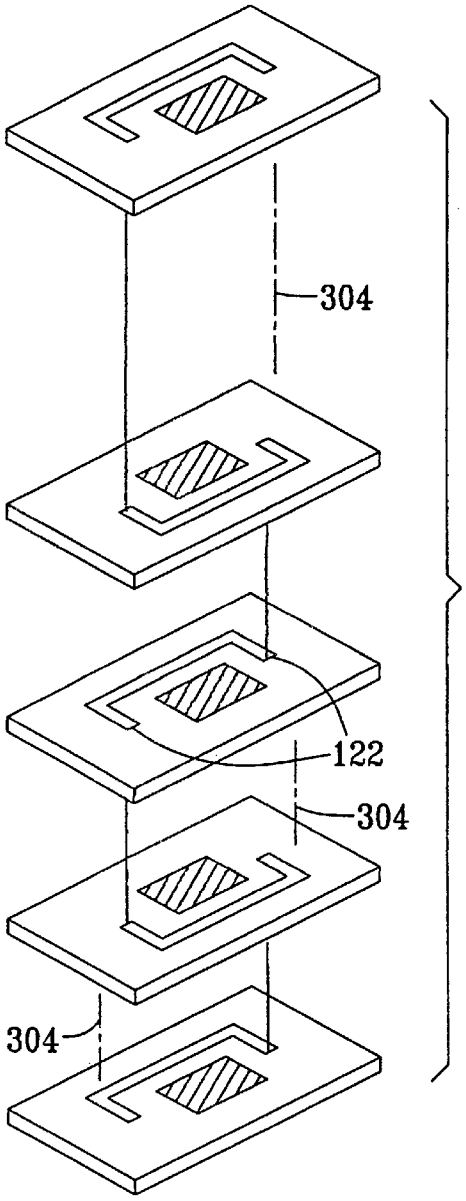
FIG. 3 is a diagram illustrating an example configuration of stacked wafers according to one embodiment of the invention.

As stated above, a plurality of wafers 100 are stacked and conductors 126 are connected using vias 122 to form a coil or other desired conductor configuration. In the embodiment illustrated in FIG. 1C, conductor 126 is approximately U-shaped, surrounding approximately one-half of ferromagnetic material 124. FIG. 3 is a diagram illustrating an example configuration of stacked wafers 100. In the example illustrated in FIG. 3, each wafer is configured such that conductor 126 is oriented 180 degrees with respect to conductor 126 on the nearest adjacent wafer 100. Connecting vias 122 in an alternating manner as illustrated by dashed lines 304 provides a continuous coil made up of connected conductors 126. Adjusting the thickness of wafers 104 adjusts the density of the windings.

Figure 4:
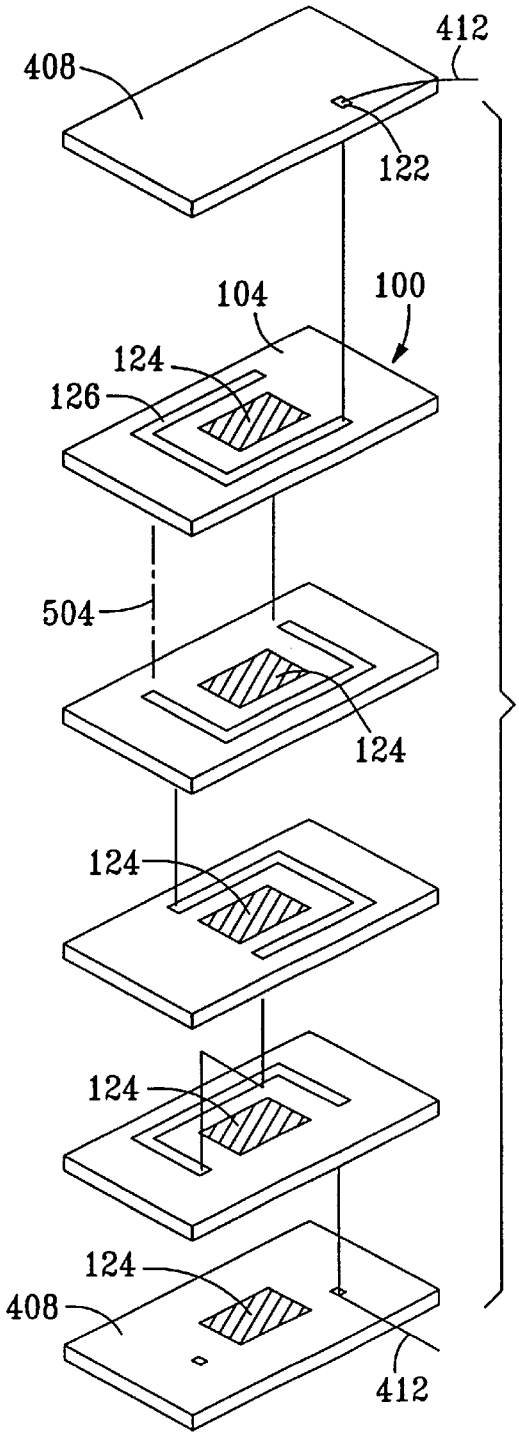
FIG. 4 illustrates an alternative configuration, wherein conductors surround approximately three-sides of the core area according to one embodiment of the invention.

FIG. 4 illustrates an alternative configuration, wherein conductors 126 surround approximately three-sides of the core area. In this embodiment, a wafer 100 is oriented 90 degrees with respect to its adjacent wafer. In relation to the embodiment illustrated in FIG. 3, this embodiment provides higher density windings for a given wafer thickness. FIG. 4 also illustrates end covers 408 used to close the ends of the device to encapsulate the core. In the illustrated embodiment, covers 408 include vias 122 to which leads 412 can be connected. In one embodiment, covers 408 are made from ceramic and have a ferromagnetic material 124 covering the surface which contacts the end wafer 100.

Figure 5:
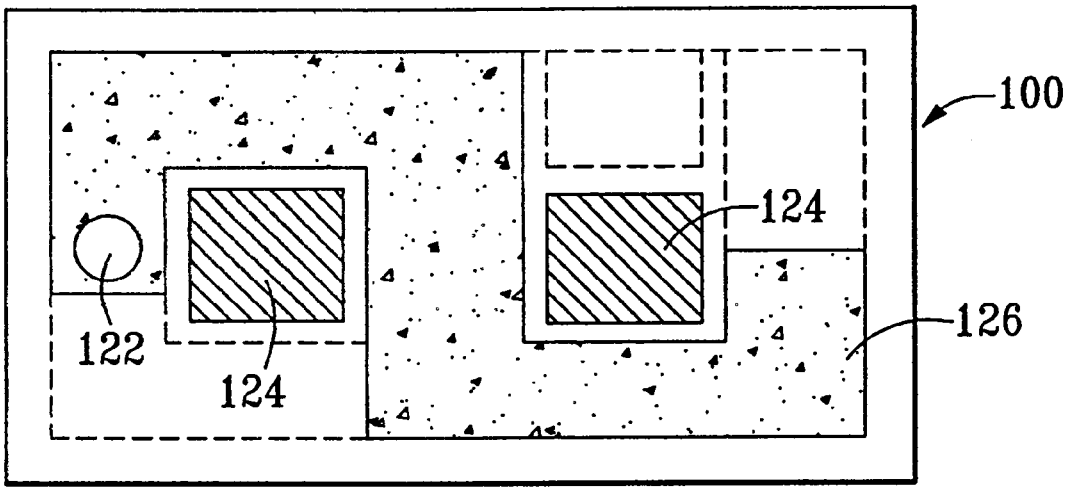
FIG. 5 is a diagram illustrating one example configuration for a wafer according to one embodiment of the invention.

In addition to the configurations illustrated above, alternative configurations can be implemented in accordance with the invention. FIG. 5 is a diagram illustrating one example configuration for wafers 100. The configuration illustrated in FIG. 5 includes a double-core arrangement, wherein each wafer 100 has two areas of ferromagnetic material 124. Conductor 126 in this embodiment, is formed in an approximate S-shape about the two core areas. When formed into a stack, the conductor pattern of each wafer 100 in the stack is the opposite of the conductor pattern of its adjacent wafer, such that when connected, conductors 126 form a figure-eight type of coil around two cores.

Figure 6:
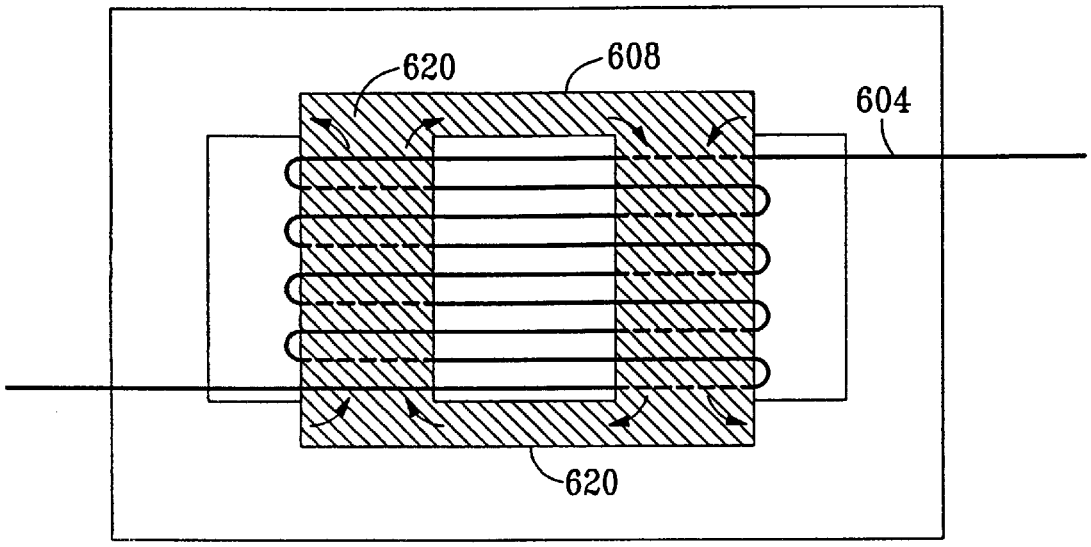
FIG. 6 is diagram illustrating a schematic representation of a toroidal effect which can be achieved with the example configuration illustrated in FIG. 5 according to one embodiment of the invention.

FIG. 6 is diagram illustrating a schematic representation of a toroidal effect which can be achieved with the example configuration illustrated in FIG. 5. As illustrated, the windings are arranged to facilitate a toroidal structure using a figure-eight conductor structure. This structure creates two distinct magnetic fields illustrated by arrows 622 which are polarized in opposite directions. These fields are effectively in series and therefore complement each other.

FIG. 5 illustrates how a core 608 and windings 604 are created using wafers 100. Additionally, one or more bridge plates 704 can be included at the top and bottom of the stack to create core 608. Illustrated in FIG. 7, a bridge plate 704 includes an area of ferromagnetic material 124 to form ferromagnetic bridge 620. Ferromagnetic bridge 608 connects the two core sections formed by ferromagnetic material 124 to create a toroidal core 608 which is approximately D shaped.

In certain configurations it may be necessary to include a wafer having only ferromagnetic material 124 and vias 122 between the top wafer 100 in the stack and bridge plates 704. Such an interposed wafer prevents conductors 126 from shorting to ferromagnetic material 124 on bridge plate 704 while joining the core materials with the bridge materials.

Figure 8A:
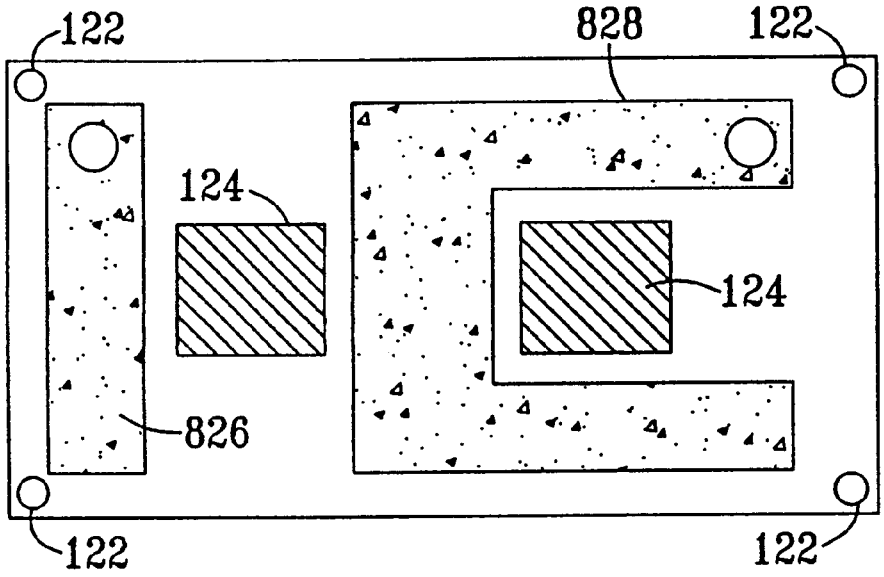
FIGS. 8A and 8B are diagrams illustrating additional alternative configurations for wafer according to one embodiment of the invention.
Figure 8B:
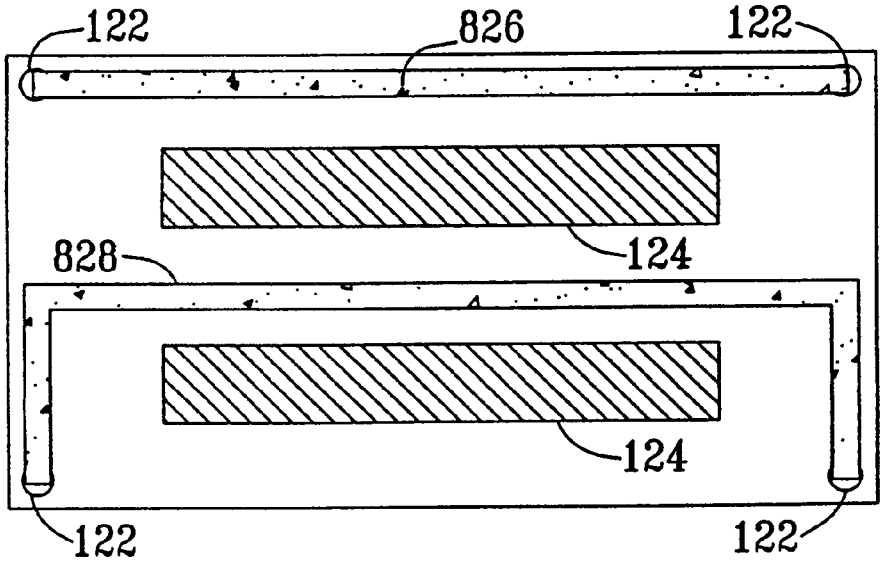

FIGS. 8A and 8B are diagrams illustrating additional alternative configurations for wafer 100. The wafers illustrated in FIGS. 8A and 8B each include two portions of ferromagnetic material 124. With these configurations, two conductors 126 are provided. A first conductor 826 is disposed in an approximately straight line along one edge of wafer 100. In the embodiment illustrated in FIG. 8A, this conductor 826 is disposed along the shorter dimension of wafer 100. In contrast, in the embodiment illustrated in FIG. 8B, conductor 826 is disposed along the longer dimension of wafer 100.

A second conductor 828 is approximately U-shaped and extends from an area between the sections of ferromagnetic material 124 and partially surrounds one of the two sections of ferromagnetic material 124. Vias 122 are provided to enable electrical connection of conductors 826, 828 when wafers 100 are formed into a stack. Additional vias 122 are also illustrated in this embodiment and can be used for alignment purposes or to bring a lead from an inner portion of the stack to an external face of the stack.

In order to create a device using wafers 100, the wafers are stacked such that each wafer is oriented 180° with respect to its adjacent wafer. Having done this, first conductor 826 on one wafer will be disposed across the open end of the second conductor 828 on the adjacent wafer. Of course, conductors 826 828 on each wafer will be separated by a dielectric material on which the conductors are disposed. Connecting adjacent conductors 826, 828 using vias 122 results in a coil configuration. Using the configurations illustrated in FIGS. 8A and 8B, devices such as toroids, transformers, or dual-core devices can be created. Cover plates can be used with or without ferromagnetic material 124 as appropriate to create the desired device.

Figure 8C:
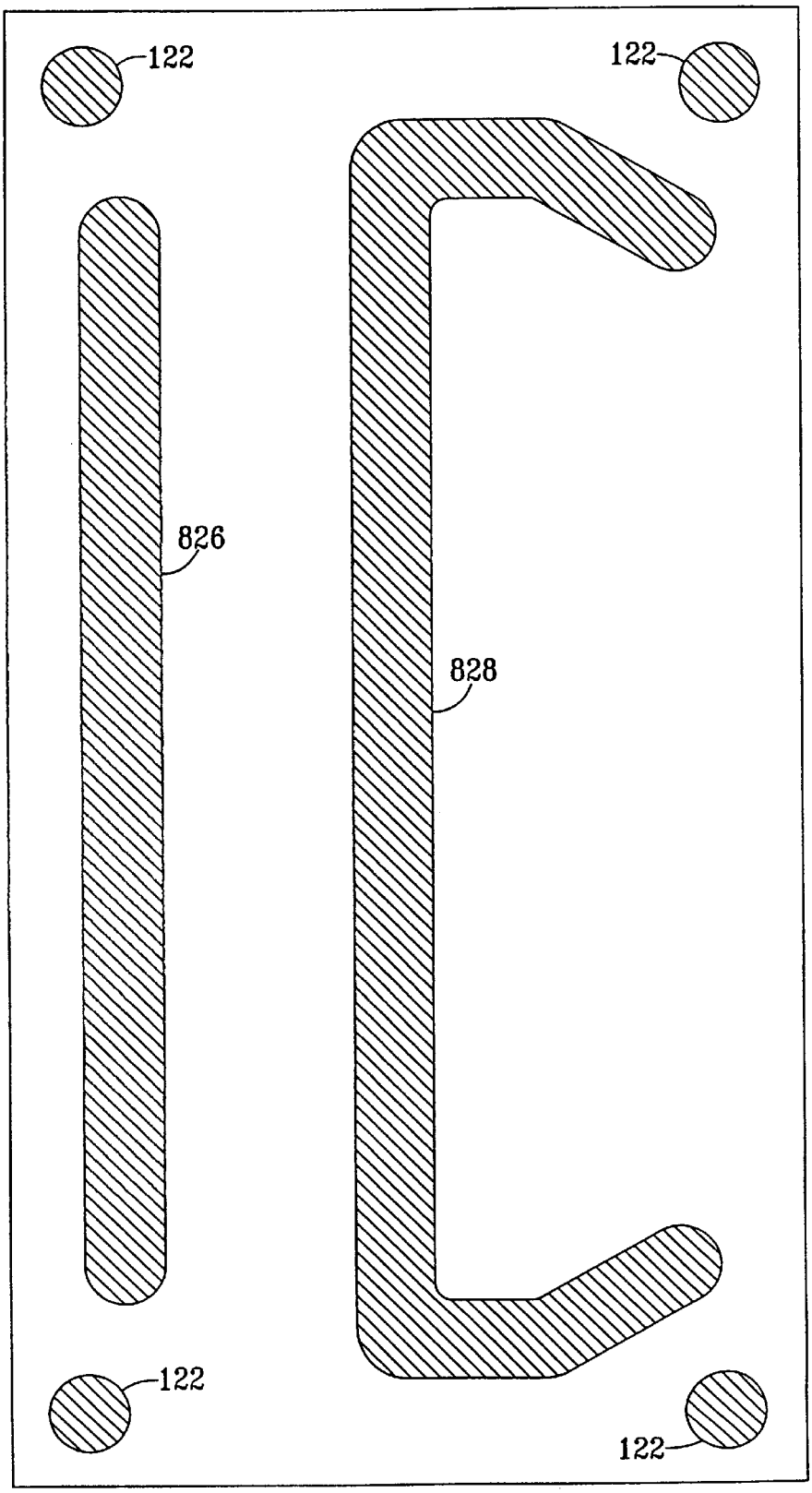
FIG. 8C is a diagram illustrating an alternative configuration for the embodiments illustrated in FIGS. 8A and 8B.
Figure 9:
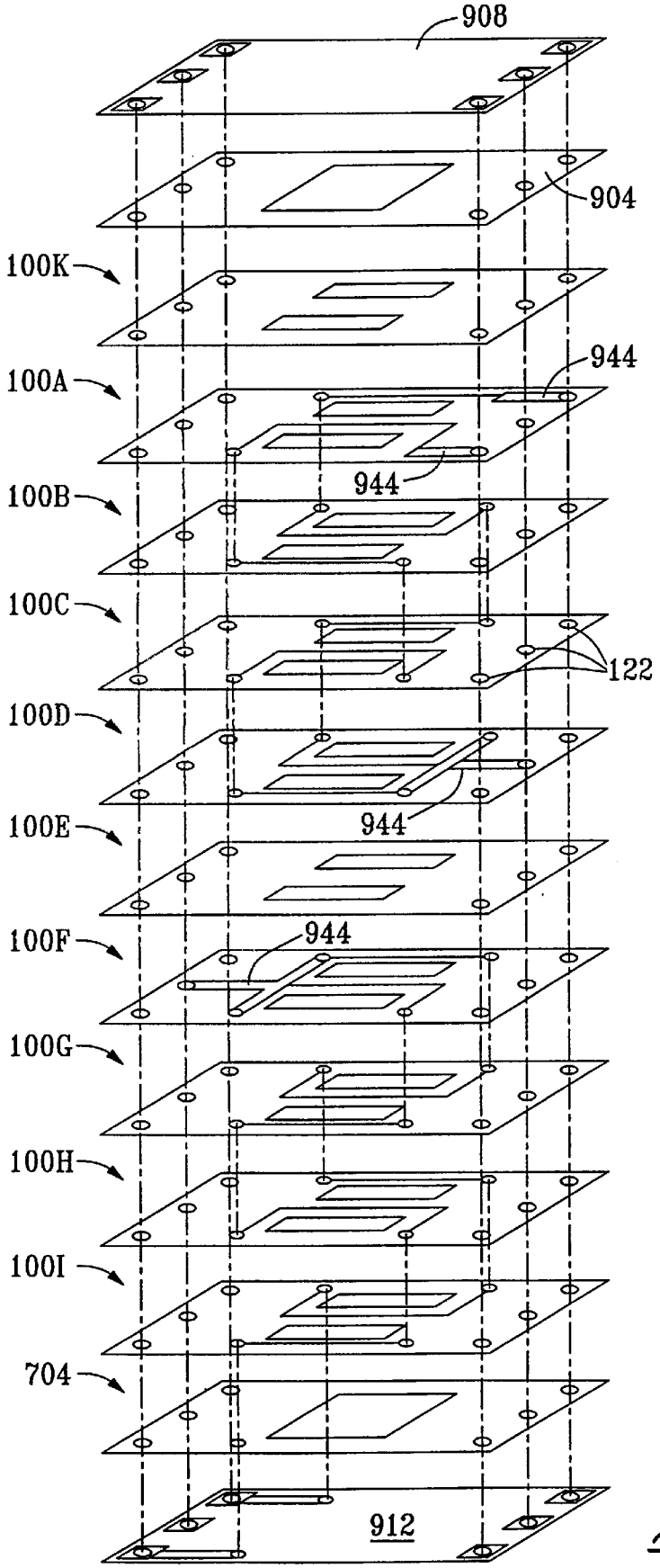
FIG. 9 is a diagram illustrating an example configuration or the wafers illustrated in FIG. 8B according to one embodiment of the invention.

FIG. 8C is a diagram illustrating an alternative configuration for the embodiments illustrated in FIGS. 8A and 8B. In the embodiment illustrated in FIG. 8C, the legs of second conductor 828 are turned inward to allow peripheral vias 122 to be positioned on wafers 100. This allows the long portion of conductor 828 to be extended to a point near the edges of wafer 100. As illustrated in FIG. 9, peripheral vias 122 allow leads, such as, for example, center-tap leads to be brought to an external surface of the package.

Figure 12A:
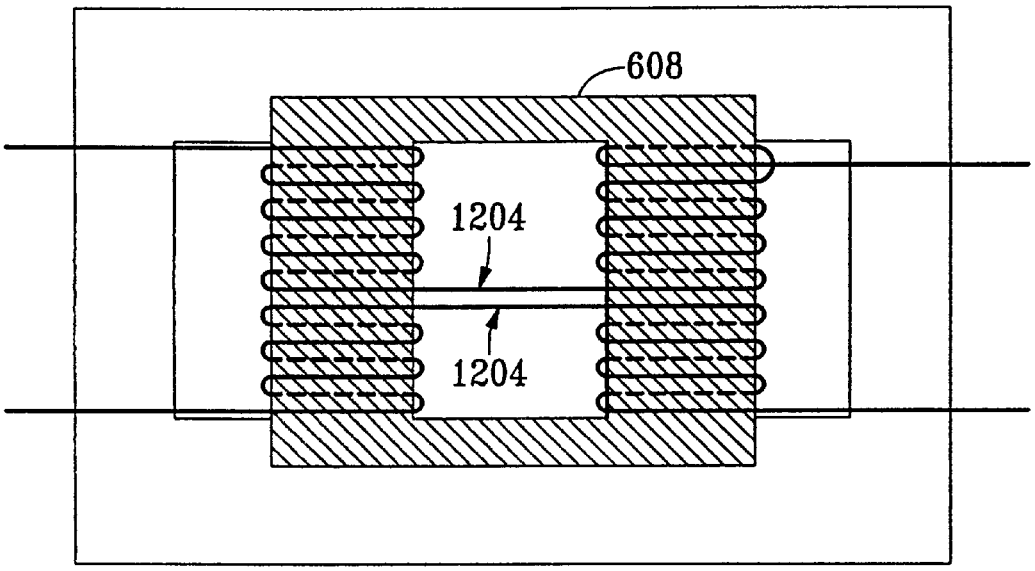
FIGS. 12A and 12B are diagrams illustrating a transformer and an inductor, respectively, which can be made using wafers 100 configured as illustrated in FIGS. 8A and 8B.
Figure 12B:
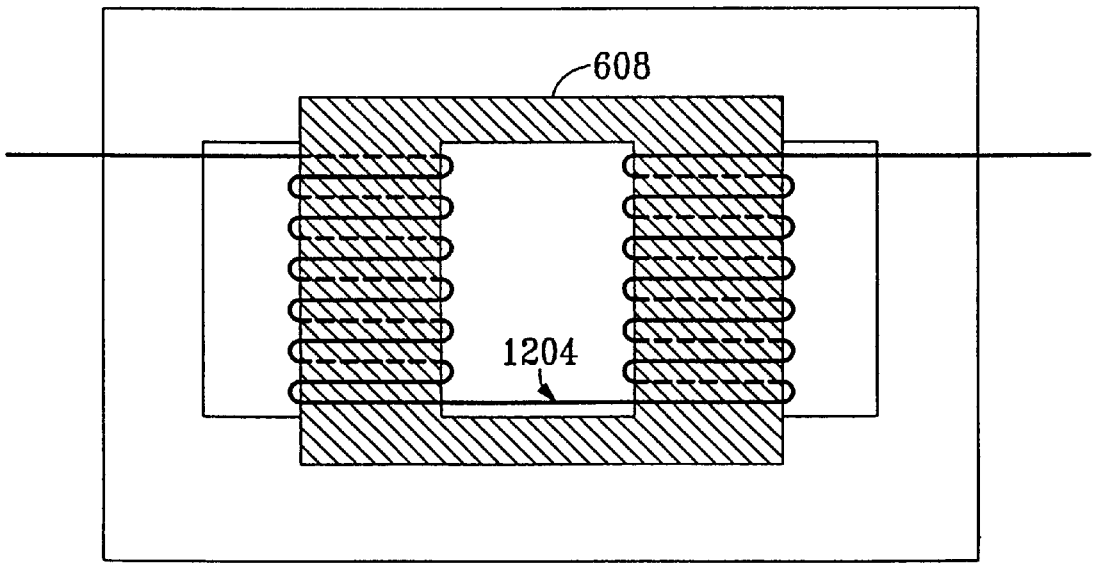

FIGS. 12A and 12B are diagrams illustrating a transformer and an inductor, respectively, which can be made using wafers 100 configured as illustrated in FIGS. 8A and 8B. Electrically connecting first conductor 826 on selected wafers 100 to second conductor 828 on adjacent wafers 100 provides windings about one of the two arms of core 608. Connecting first conductor 826 on an end wafer 100 to second conductor 828 on the same wafer provides electrical connection 1204 to continue the windings about the other arm.

FIG. 9 is a diagram illustrating an example configuration of the wafers illustrated in FIG. 8B. The example illustrated in FIG. 9 represents a transformer having two center taps. Referring now to FIG. 9, the illustrated device includes eleven wafers 100, as well as two bridge plates 704 a top cover plate 908 and a bottom cover plate 912.

Wafers 100A–100D and 100F–100I each include two conductors 826, 828 (reference numerals omitted from FIG. 9 for clarity but are referenced in FIG. 8B). As illustrated, one conductor is approximately U-shaped and the other is formed in an approximately a straight line. Although conductors 826, 828 are illustrated in FIG. 9 as being lines having minimal width, the width of conductors 826, 828 is chosen based on the conductivity required as well as their proximity to ferromagnetic material 124 and the resistivity of the dialectic material used to form the substrate of wafers 100. As would be apparent to one of ordinary skill in the art, the conductivity of the conductors 126 as well as their proximity to ferromagnetic material 124 must be considered such that conductors 126 do not short to ferromagnetic material 124.

Joining wafers 100E are provided to allow the core sections of core 608 to continue from one set of windings to the other without shorting the windings. Joining wafer 100K allows the arm sections of core 608 to connect to bridge plate 704 without shorting the windings. Joining wafers 100E and 100K provide one or more sections of ferromagnetic material 124 to provide continuity for the ferromagnetic core and magnetic flux. To eliminate shorting, in the illustrated embodiment, joining wafers 100E, 100K have no conductors on either side. Joining wafers 100E, 100K can still have vias to allow signals to pass to the ends of the stack.

As illustrated, numerous vias 122 are provided and can be generally categorized as providing two functions. A first function performed by certain vias 122 is to interconnect conductors 126 of adjacent wafers to form the desired coil or winding structure. The second grouping of vias 122 provides a means by which leads can be brought to the top or bottom of the device, such as, for example, to provide connection to a center tap winding and also to provide connections, such as, for example surface mount terminals.

In the example device illustrated in FIG. 9, additional conductors 944 are provided to bring signals from conductors 826, 828 to appropriate vias 122 to provide, for example, a means by which a center tap lead can be brought from the coil structure to a point external to the package. Additional conductors 944 also provide connections between first and second conductors 826, 828 on the same wafer to provide electrical connection 1204. Dashed lines illustrate connections among vias 122 for the example illustrated in FIG. 9.

Due to the mutual inductance of the windings, a higher overall inductance value can be obtained for a given number of turns in this and other configurations. The cumulative effect of the inductances in this configuration is shown by $$L_T = \left(\sqrt{L_1} + \sqrt{L_2}\right)^2 4L$$

where $$L_M = 2P\sqrt{L_1 L_2}$$

or $$L_T = \left(\sqrt{L_1} + \sqrt{L_2}\right)^2$$

which is approximately 4L.

Where, L is inductance of the respective coil, P is a coefficient of coupling between the coils, and $L_m$ is the mutual inductance of the coils. L1 +L2 and P are expressed as a value of the magnetic field generated by one coil linked with the other.

After reading this description, it would be apparent to a person skilled in the relevant art how to provide different configurations of wafers and different configurations of interconnections among the wafers to provide different devices utilizing the technology disclosed herein.

The numerous embodiments described include a separate core material disposed within a cavity in the dielectric wafer. In alternative embodiments, a highly resistive ferromagnetic material can be used to form the wafers. Because the material has magnetic properties, no separate core is needed and a solid wafer can be used. For example, a Zinc-Nickel composition can be used to form the wafers. In these embodiments, because there is no separate core structure and hence no dielectric forming an insulating barrier between the ferromagnetic material and the conductive windings, a lower permeability and higher resistivity ferromagnetic material is used. For example, in one embodiment, the wafers have up to 3000$\mu$ permeability and $10^{-6}$ ohms centimeter resistivity.

In this embodiment, a highly resistive material is used to avoid shorting the conductive traces disposed thereon. Because of the higher resistivity and lower permeability, device characteristics are generally different from those which can be obtained using the above-described embodiments having discrete core sections.

Figure 10:
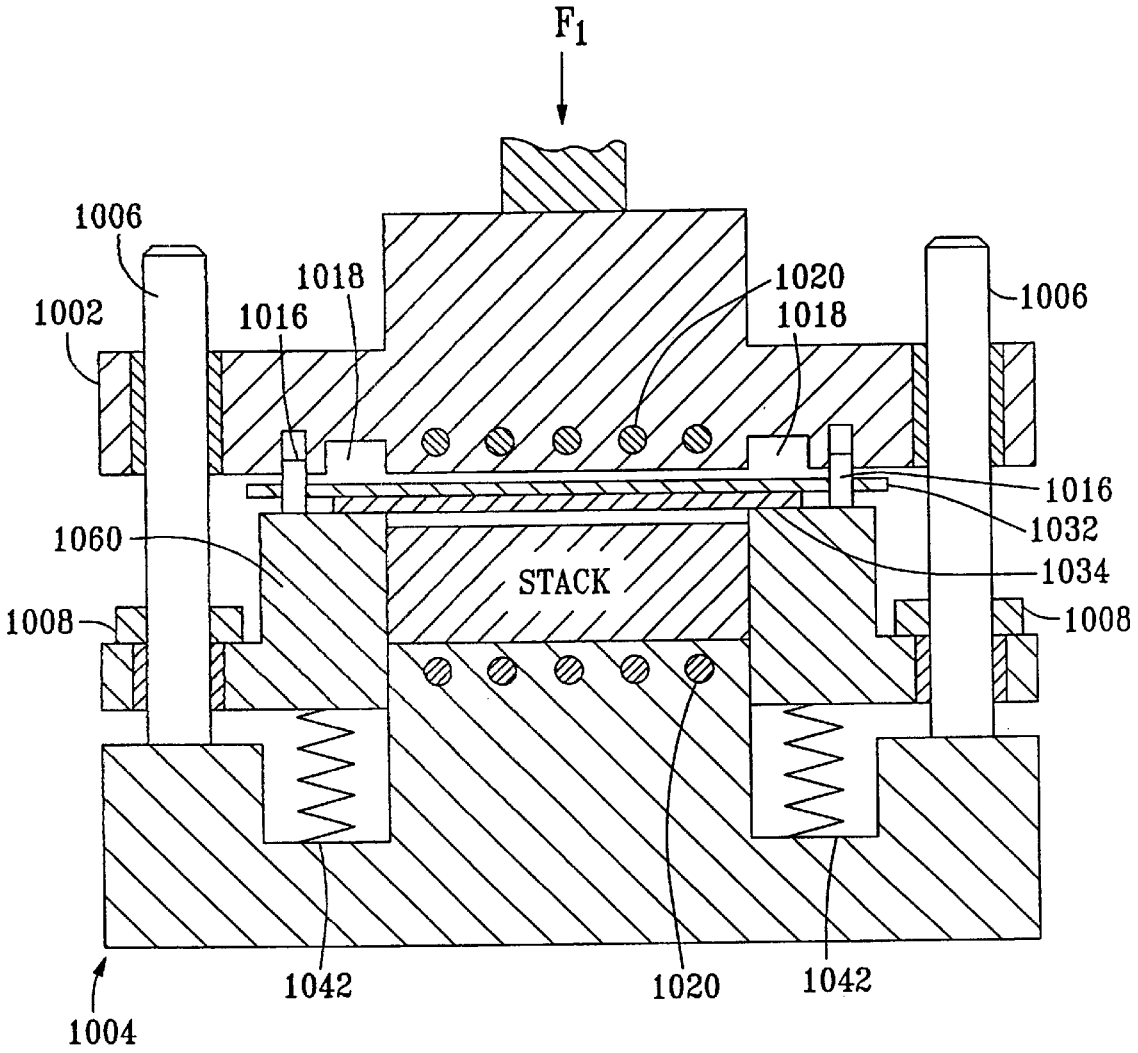
FIG. 10 is a diagram illustrating a tool which can be used for performing the operation of stacking wafers and removing the substrate according to one embodiment of the invention.

As discussed above, in one embodiment wafers 100 are cast onto a substrate such as, for example, Mylar. In order to prepare a stack of wafers to make a device, each wafer 100 is removed from the Mylar and stacked on top of a previous wafer in the appropriate orientation. FIG. 10 is a diagram illustrating a tool which can be used for performing the operation of stacking wafers 100 and removing the Mylar substrate. The tool illustrated in FIG. 10 includes a top portion 1002 for applying pressure to the wafer and a bottom portion 1004 for receiving wafer 100 in forming a stack. Alignment guides 1006 align with holes in top portion 1002 to align top portion 1002 to bottom 1004.

Die 1060 is used to cleave the edges of wafer 1034 as top portion 1002 presses wafer 1034 and carrier 1032 onto the stack. Springs 1042 provide enough pressure to allow the tool to cleave the edges of wafer 1034, such that a wafer 100 of the appropriate size is cut. Springs 1042 can have an adjustable or fixed pressure constant. Pressure relief cavities 1018 provide an edge for the cutting function and a space for the cleaved perimeter of wafer 1034. Stop rings 1008 prevent die 1060 from rising above a set height when pressure is removed from top portion 1002.

Heaters 1020 are provided to apply heat to the wafers as they are removed from carrier 1032 and positioned on the stack. Heat facilitates removal. Alignment pins 1016 are used to align wafer carrier 1032 (e.g., mylar or other substrate) such that wafer 100 is properly positioned and aligned to be placed on the stack.

Figure 11:
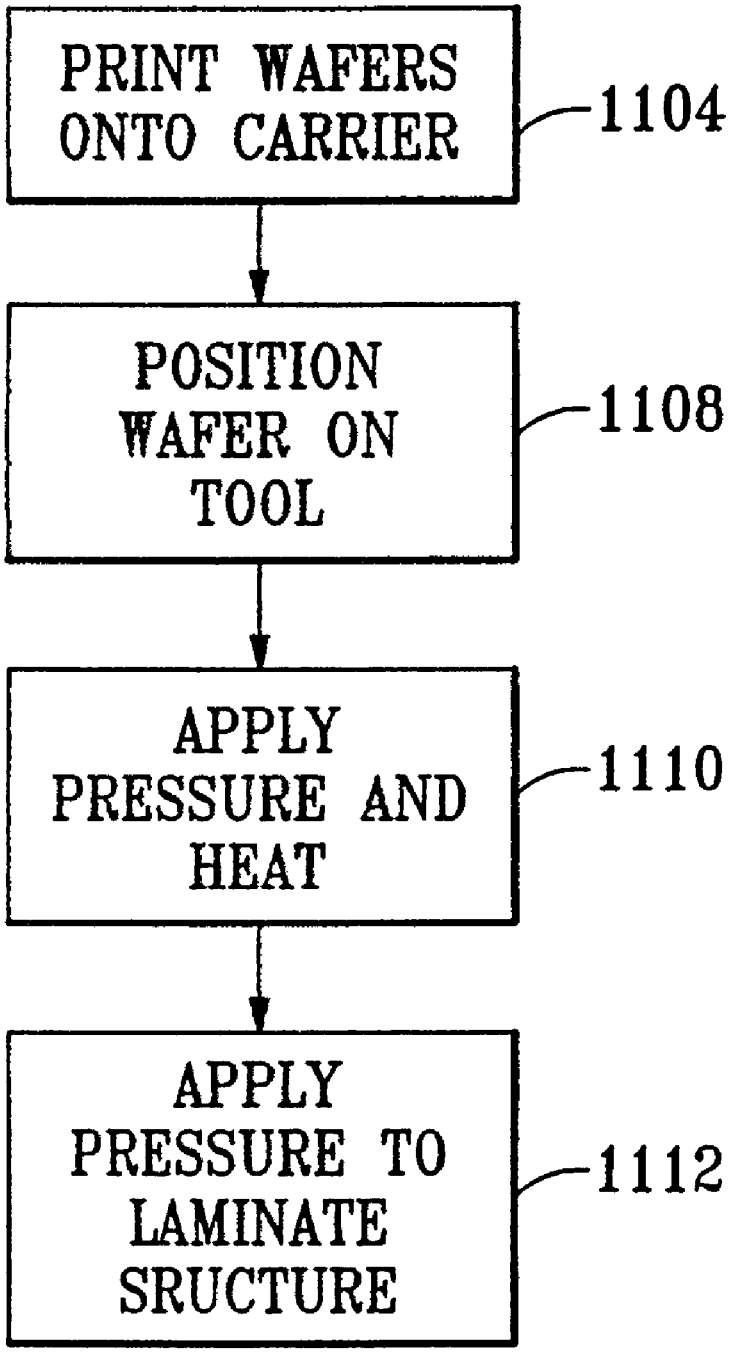
FIG. 11 is a flowchart illustrating a process for using this tool illustrated in FIG. 10 to create a device according to one embodiment of the invention.

FIG. 11 is a flowchart illustrating a process for using this tool to create a device in accordance with one embodiment of the invention. In a step 1104 wafers are printed onto a carrier such as, for example, Mylar. The wafers can be printed such as, for example, a screen printing technique such as that described above. The carrier can include alignment holes or notches such that proper alignment can be maintained during the printing and pressing processes.

In one embodiment, the dielectric material is printed onto a mylar carrier. The mylar is a continuous roll of material which is passed below an elongated funnel. The dielectric material prepared with the proper viscosity is forced through the funnel onto the passing carrier for a set period of time, depending on the width desired. A wiper blade maintains the proper and uniform thickness of dielectric material. The dielectric is formed in a slightly larger size than the finished dimensions of a wafer 100. In one embodiment, the mylar tape is cast and dried. Preferably, the tape is a 10 ml tape and is dried at 50° C. for 10 min. Next, the tape is cut and punched, the vias are printed or filled, the ferrite is printed or filled, and the conductors are printed or filled. Between each printing is a drying step. In one embodiment, the dialectic is printed first, then the ferrite and conductors are added, again with a drying step in between each printing.

In a step 1108 the prepared wafer 100 (including cores, vias and conductors as appropriate) is positioned on the alignment tool. In FIG. 10, a wafer 100 is illustrated as being positioned within the tool and still attached to carrier 1032. As illustrated, dimensions of wafer 100 are slightly larger than the cavity dimensions of die 1060. Cavity dimensions of die 1060 reflect the finished dimensions of wafers 100.

In a step 1110, pressure and heat is applied to the wafer/carrier combination. Enough pressure is applied to cleave wafer 100, without overcoming the force of springs 1042. This cuts or cleaves wafer 100 to the proper dimensions. The heat facilitates removal of cleaved wafer 100 from carrier 1032, and the wafer falls onto the stack. Top portion 1002 is lifted and carrier 1032 is removed.

In a step 1112, pressure is again applied to cleaved wafer 100. In this step enough pressure is applied to overcome the force of springs 1042 and wafer 100 is pressed onto the stack. For example, in one embodiment, a pressure of 3000 PSI is applied at 80–100 degrees Centigrade for five seconds, although alternative parameters can be used. As a result of this step, the subject wafer 100 adheres to the existing stack of wafers 100. A wax or glue-like material can be applied to each wafer in the stack before the subsequent wafer is pressed on top to enhance the adherence of the wafers.

While various embodiments of the present invention have been described above, it should be understood that they have been presented by way of example only, and not limitation. Thus, the breadth and scope of the present invention should not be limited by any of the above-described exemplary embodiments, but should be defined only in accordance with the following claims and their equivalents.

What is claimed is:

1. A method of making a device having a core and a conductor structure comprising:

fabricating a plurality of non-conductive plates using a non-conductive media, each said non-conductive plate having a cavity and a via;

disposing a predetermined conductive pattern on said non-conductive plates;

depositing a ferromagnetic material in said cavities;

positioning said plurality of plates together such that said ferromagnetic material is aligned to form a ferromagnetic core, and said conductive patterns and said vias cooperate to form windings about said core; and sintering said positioned plurality of plates to compress and encase said core in the non-conductive material, wherein as a result of said compression, the ferromagnetic properties of said core are enhanced.

2. The method according to claim 1, wherein said step of fabricating a plurality of non-conductive plates comprises the steps of preparing said non-conductive material as a printable ink and printing said non-conductive ink onto a carrier.

3. The method according to claim 2, wherein said non-conductive material is a dielectric material.

4. The method according to claim 2, wherein said carrier is a mylar sheet having alignment guides.

5. The method according to claim 1, further comprising the step of positioning cover plates on the ends of said positioned plurality of plates before said sintering step.

6. The method according to claim 1, wherein said step of depositing said ferromagnetic material comprises the steps of preparing said ferromagnetic material as a printable ink and printing said ferromagnetic ink into said cavity.

7. The method according to claim 1, wherein said step of positioning said plurality of plates together comprises the step of placing a plate with a carrier on an adjacent plate and applying pressure to said plate to adhere said plate to said adjacent plate and removing said carrier from said plate.

8. The method of claim 1, wherein said plates comprise a second cavity wherein said second cavity is filled with ferromagnetic material to form a second ferromagnetic core.

9. The method of claim 8, further comprising the step of positioning one or more plates having a ferromagnetic material spanning said ferromagnetic core and second ferromagnetic core on top of said positioned plurality of plates to form a bridge.

10. A method as claimed in claim 1 and further comprising, prior to the step of positioning said plates together, a step of drying said plates at moderate temperatures.

11. A method as claimed in claim 10, wherein said plates are dried at 50° C. for approximately five to ten minutes.

12. A method as claimed in claim 1 and further comprising, following the step of positioning said plates together, a step of laminating said positioned plates to form a laminated structure.

13. A method as claimed in claim 12, wherein during lamination said plates are pressurized at approximately 3000 PSI and are heated at approximately 80° C. to 100° C.

14. A method as claimed in claim 12 and further comprising, following the step of laminating said plates, the step of heating said laminated structure at a moderate temperature to remove organic materials.

15. A method as claimed in claim 14, wherein said laminated structure is heated at approximately 350° C. for approximately twenty hours.

16. A method as claimed in claim 1, wherein during sintering said plates are fired at approximately 920° C. for approximately one hour.

17. An inductive device made up of a plurality of wafers laminated in a stack, said wafers comprising:

a dielectric material having first and second cavities;

ferromagnetic material disposed in said cavities, said ferromagnetic material forming a first and second core section when said wafers are laminated to form the stack;

a first conductor adjacent to and running approximately the length of said first cavity; and a second conductor adjacent to and partially surrounding said second cavity;

wherein said first conductor of one or more of the wafers in the stack is connected to said second conductor of adjacent wafers in the stack to form conductive windings about said first and second core sections.

18. The inductive device of claim 17, further comprising an electrical connection between said first and second conductors of a wafer to provide mutual inductance among said first and second core sections.

19. The inductive device of claim 17, further comprising first and second bridge wafers positioned on the top and bottom of the stack thereby forming a bridge connecting said first and second core sections and forming an approximately D-shaped core.

20. The inductive device of claim 19, further comprising:

a joining wafer between a first set of wafers and a second set of wafers in said laminated stack said joining wafer providing continuity of said first core section of the first set of wafers with said first core section of said second set of wafers and continuity of said second core section of the first set of wafers with said second core section of said second set of wafers;

a first electrical connection between said first and second conductors of a wafer of said first set adjacent to said joining wafer; and a second electrical connection between said first and second conductors of a wafer of said second set adjacent to said joining wafer thereby forming a transformer as the inductive device.

21. An inductive device, comprising:

a plurality of dielectric wafers having a cavity, a second cavity, a conductive pattern and a second conductive pattern disposed thereon, said wafers being stacked to form a laminate structure;

a bridge plate connecting said cavity and said second cavity;

a ferromagnetic material disposed within said cavity and said second cavity of said dielectric wafers, such that when said wafers are stacked to form said laminate structure, said ferromagnetic material forms ferromagnetic cores; and interconnections connecting said conductive patterns on said wafers to form a winding structure about said ferromagnetic cores;

wherein said laminate structure is sintered to compress said cores thereby enhancing the ferromagnetic properties of said cores.

* * * * *

UNITED STATES PATENT AND TRADEMARK OFFICE

CERTIFICATE OF CORRECTION

PATENT NO. : 5,945,902

DATED : August 31, 1999

INVENTOR(S) : Lipkes et al

It is certified that error appears in the above-identified patent and that said Letters Patent is hereby corrected as shown below:

On the title page, item [73]

Assignee: delete "Zefv" and insert --Zeev--.

Signed and Sealed this

Fourth Day of April, 2000

*Attest:*

*Attesting Officer*

Q. TODD DICKINSON

*Director of Patents and Trademarks*